US007980612B2

(12) United States Patent
Hall et al.

(10) Patent No.: US 7,980,612 B2
(45) Date of Patent: Jul. 19, 2011

(54) CLAMPING ASSEMBLY

(75) Inventors: David R. Hall, Provo, UT (US); Jay Reynolds, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 511 days.

(21) Appl. No.: 11/179,975

(22) Filed: Jul. 12, 2005

(65) Prior Publication Data

US 2007/0013199 A1 Jan. 18, 2007

(51) Int. Cl.
*B66C 1/42* (2006.01)

(52) U.S. Cl. ..... 294/106; 294/81.61

(58) Field of Classification Search ..... 294/119.1, 294/88, 106, 81.61
See application file for complete search history.

(56) References Cited

U.S. PATENT DOCUMENTS

| | | | | |
|---|---|---|---|---|
| 1,765,023 | A | 6/1930 | McWane | |
| 1,767,525 | A | 6/1930 | Hoffman | |
| 3,154,338 | A | 10/1964 | Leach | |
| 3,596,970 | A | 8/1971 | Levert | |
| 3,677,599 | A | 7/1972 | Shannon | |
| 3,976,321 | A | 8/1976 | Dean | |
| 4,008,814 | A | 2/1977 | Kral | |
| 4,336,926 | A * | 6/1982 | Inagaki et al. | 294/88 |
| 4,432,691 | A | 2/1984 | Sterner | |
| 4,531,875 | A | 7/1985 | Krueger | |
| 4,604,724 | A | 8/1986 | Shaginian | |
| 4,975,018 | A | 12/1990 | Langenbacher | |
| 5,184,861 | A * | 2/1993 | Voellmer | 294/119.1 |
| 5,360,248 | A * | 11/1994 | Jones | 294/87.1 |
| 6,305,728 | B1 | 10/2001 | Holter | |
| 6,592,324 | B2 * | 7/2003 | Downs et al. | 294/119.1 |
| 6,820,849 | B2 | 11/2004 | Kennard | |
| 6,846,331 | B2 | 1/2005 | Senoir | |
| 7,503,606 | B2 * | 3/2009 | Hall et al. | 294/81.52 |

* cited by examiner

*Primary Examiner* — Paul T Chin
(74) *Attorney, Agent, or Firm* — Holme Roberts & Owen LLP

(57) ABSTRACT

A clamping assembly for use in gripping an object. The clamping assembly includes a pair of opposed jaws, with each jaw having a pivot end pivotally attached to a frame structure, a clamp end opposite the pivot end, and a socket located between the clamp end and the pivot end. The clamping assembly further includes first and second balls rotatably mounted in the sockets of the opposed jaws, and a gear assembly connected to both of the first and second balls that includes a primary gear mechanically associated with a power source. Rotation of the primary gear by the power source results in actuation of the clamping assembly.

25 Claims, 14 Drawing Sheets

CLAMPING ASSEMBLY

BACKGROUND OF THE INVENTION

The present invention pertains to clamping assemblies, specifically clamping assemblies used in manufacturing and material handling. While transporting large objects a clamping assembly may be desired. In the prior art, several references disclose apparatuses and methods for gripping, grabbing, supporting, sensing and transporting objects of varying size and weight.

U.S. Pat. No. 4,432,691, which is herein incorporated by reference for all that it discloses, discloses a self-contained power-operated manipulator for piping and the like and is capable of coordinated movements which approximate those of the human arm and hand.

U.S. Pat. No. 5,184,861, which is herein incorporated by reference for all that it discloses, discloses a split rail gripper for robotic apparatus and including a pair of rails which are driven in mutually opposite directions by a rack and pinion gear mechanism. Each rail includes a set of rack gear teeth which engage respective pinion gears and where the top rail engaging one of the pinion gears is driven by a harmonic gear reduction drive and motor unit coupled to a drive screw. The other pinion gear is driven by the top pinion gear engaging a set of rack gear teeth included in the bottom rail. As the top rail is driven in or out, the upper pinion gear is rotated, causing the other pinion gear, in turn, to rotate in the opposite direction. This causes the bottom rail to move in an opposite linear direction relative to the top rail. An outwardly extending gripper finger assembly is attached to respective ends of the rails, with each gripper finger including an arrangement of vertically and horizontally mounted roller members which operate to automatically center and engage an H-plate type interface secured to the object being grasped. The gripper assembly also includes a base plate attached to an interface plate of a robotic tool changer mechanism. A retractable rotary tool driver and tool is also centrally mounted on the base plate.

U.S. Pat. No. 6,820,849, which is herein incorporated by reference for all that it discloses, discloses a clamping device including a fixed jaw attached to one end of a threaded shaft and an adjustable jaw which is movably mounted on the threaded shaft.

U.S. Pat. No. 4,604,724, which is herein incorporated by reference for all that it discloses, discloses an automated apparatus for handling elongated well elements such as pipes. An automatic tong is provided for screwing and unscrewing pipes from a string of elongated well elements. A manipulator grips and delivers a pipe to an operation position in axial alignment with the well bore. A control system includes position sensors for sensing the position of a well pipe. The control unit also includes a programmed logical control unit through which the sensors are connected to a drive system.

U.S. Pat. No. 4,531,875, which is herein incorporated by reference for all that is discloses, discloses an automated pipe handling system for providing increased safety and to minimize the number of workmen required in the coupling and uncoupling of pipe stands. The system includes a programmable controller for monitoring and/or controlling devices which remove and add pipe stands to a drill column. A number of transducers are operatively connected to the controlled devices for communication with the programmable controller for use in verifying that the controlled devices have properly performed their programmed tasks. The controlled devices include upper and lower arm assemblies for use in engaging and moving the uncoupled pipe stands to a storage position.

The controlled devices further include a finger board assembly and a set-back assembly. The finger board assembly moves and retains the upper portions of the pipe stands while a drill rig floor of a derrick supports their lower portions. The set-back assembly is used to hold the lower portions of the pipe stands and to move the pipe stands to the predetermined storage positions on the drill rig floor.

U.S. Pat. No. 6,846,331, which is herein incorporated by reference for all that it discloses, discloses a gripper device comprising at least two portions which are coupled together and which may be moved towards one another to effect a gripping action and away from one another to effect a release action. An electrical motor is arranged to effect such movement, and a battery is connected to supply electrical current to the motor. A capacitor device is also connected to be capable of supplying electrical current to the electrical motor. A control device is arranged to cause the capacitor device to supply electrical current to the electrical motor after supply of electrical current to the electrical motor by the battery, to increase the strength of the gripping action.

BRIEF SUMMARY OF THE INVENTION

A clamping assembly for use in gripping, grabbing, supporting, sensing and transporting objects of varying size, shape and weight is disclosed. The clamping assembly has opposed jaws each with a ball and socket apparatus intermediate a clamp end and a pivot end attached to a frame structure. In one aspects of the invention, the frame structure may have a stabilizing member. The ball and socket apparatuses are connected by a gear assembly with a primary gear in mechanical communication with a power source wherein the jaws are actuated in accordance with the rotation of the primary gear.

The gear assembly may have a rod wherein the primary gear is intermediate oppositely threaded ends of the rod. The ends of the rod may be threadedly connected to the ball and socket apparatuses. The primary gear may be selected from the group consisting of spur gears, helical gears, crossed helical gears, bevel gears, spiral bevel gears, hypoid gears and zerol gears.

The primary gear may also be a pinion gear in mechanical communication with rack gears pivotally connected to the ball and socket apparatuses. As the pinion gear rotates the rack gears linearly extend out or retract in depending on the direction of rotation of the pinion gear.

The clamping assembly may have a sensor selected from the group consisting of torque sensors, pressure sensors, position sensors, strain sensors, optical sensors, sonic sensors, seismic sensors, acoustic sensors, inductive sensors, capacitive sensors, magnetic sensors, temperature sensors, vibrations sensors, sway sensors, smart sensors, and weight sensors.

The clamping assembly may move in a horizontal direction, a vertical direction or both directions with respect to the frame structure. The clamping assembly may also rotate axially or horizontally with respect to the frame structure.

The clamping assembly may have a control unit selected from the group consisting of integrated circuits, microprocessor chips and field-programmable gate array's (FPGA's). The control unit may receive operating instructions from an input device selected from the group consisting of controllers, remote controls, radio controls, sensors, memory and computers. The clamping assembly may also have memory.

The clamping assembly may include a closed loop control system. The closed loop control system may have control elements selected from the group consisting of sensors, control units, transmission mediums, power sources, actuators, indicators and computer memory.

The power source may be selected from the group consisting of motors, engines and hydraulics. The power source may be in mechanical communication with the primary gear by a mechanical device selected from the group consisting of gears, belts, bands, wheels, pulleys, chains, ropes, rods, shafts and combinations of the above.

The clamp end may have a gripping surface selected from the group consisting of elastomer coated surfaces, grooved surfaces, curved surfaces and rough surfaces. The pivot end of the jaw may be attached to the frame structure by a connection selected the group consisting of hinges, swivels, ball and sockets apparatuses and pivots.

In other aspects of the invention a lifting assembly may comprise a clamping assembly with opposed jaws each having a ball and socket apparatus intermediate a clamp end and a pivot end attached to a frame structure of the lifting assembly. The ball and socket apparatuses are connected by a gear assembly comprising a primary gear in mechanical communication with a power source. Wherein, the jaws are actuated in accordance with the rotation of the primary gear.

The lifting assembly may have a sensor selected from the group consisting of torque sensors, pressure sensors, position sensors, strain sensors, optical sensors, sonic sensors, seismic sensors, acoustic sensors, inductive sensors, capacitive sensors, magnetic sensors, temperature sensors, vibrations sensors, sway sensors, smart sensors, and weight sensors.

The lifting assembly may comprise at least a portion of a closed loop system. The at least portion of the closed loop system may have elements selected from the group consisting of sensors, control units, transmission mediums, power sources, actuators, indicators and memory.

DETAILED DESCRIPTION OF EXEMPLARY EMBODIMENTS

Figure 1:
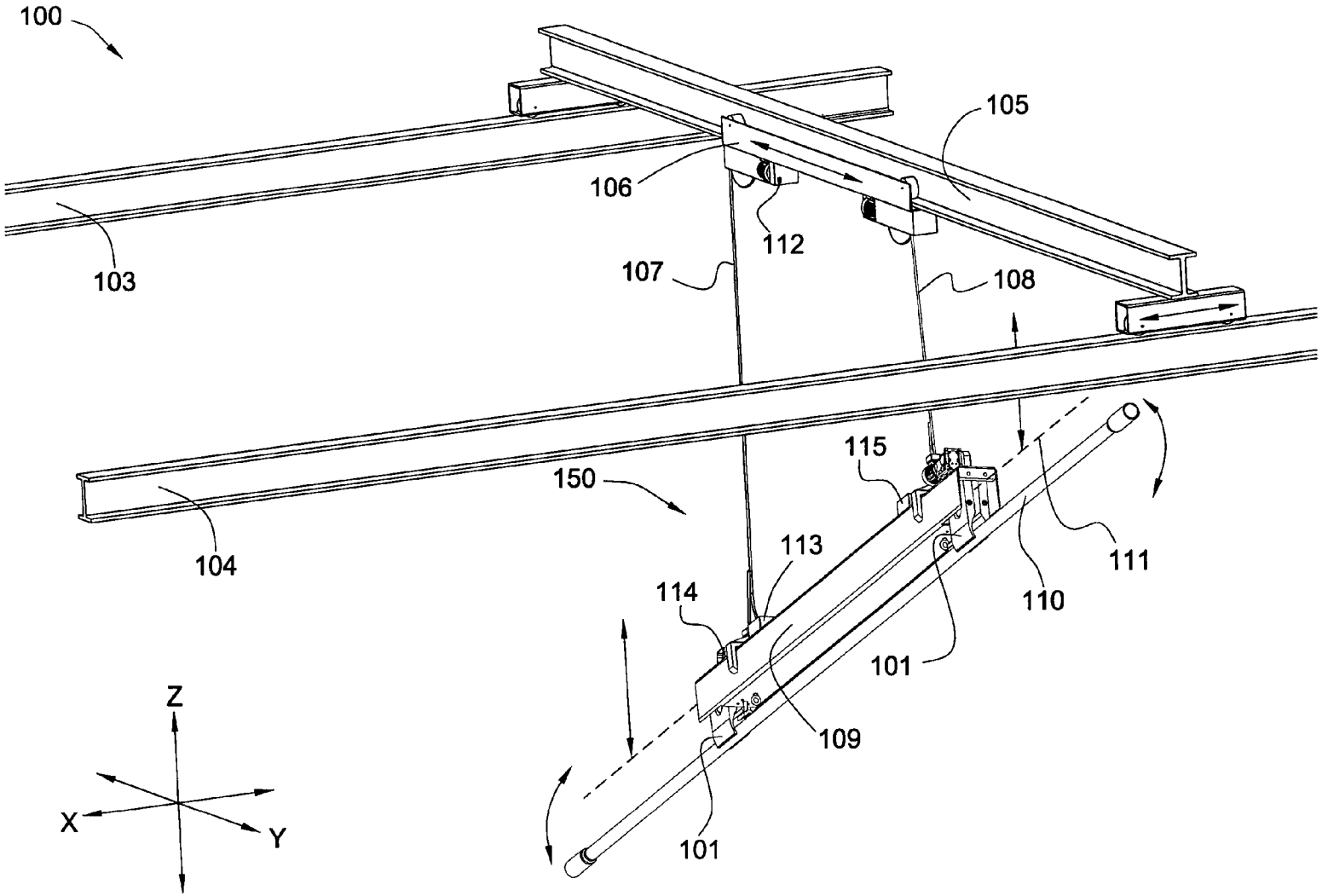
FIG. 1 is a perspective diagram of a lifting assembly with multiple clamping assemblies.

Referring now to the drawings, FIG. 1 is a perspective diagram of a lifting assembly 100 comprising clamping assemblies 101. The clamping assemblies 101 may be attached to a frame structure 109 along a common axis 111. The lifting assembly 100 may comprise two beams 103, 104 affixed parallel to each other and a third beam 105 perpendicular to the parallel beams 103, 104. The third beam 105 may be able to move along the parallel beams 103, 104 along an x-axis. The third beam 105 may comprise a gliding assembly 106 which may comprise cables 107, 108 attached to the frame structure 109 of the clamping assemblies 101. The gliding assembly 106 may be able to move along the third beam 105 along a y-axis as well as adjust the length of the cables 107, 108 attached to the frame structure 109 along a z-axis. Such an arrangement may allow the position, angle and the height of the frame structure 109 to be adjusted. This may be used for moving objects 110 from a horizontal position to a vertical position as diagramed in FIG. 1. This may be useful for a storage facility.

The third beam 105 and gliding assembly 106 may comprise an anti-sway mechanism (not shown) adapted to control any swinging movements of the frame structure 109. The anti-sway mechanism may prevent the frame structure 109 from swinging by gradually starting and stopping any movement of the gliding assembly 106 or third beam 105.

The lifting assembly 100 may comprise one or more sensors 112 selected from the group consisting of torque sensors, pressure sensors, position sensors, strain sensors, optical sensors, sonic sensors, seismic sensors, acoustic sensors, inductive sensors, capacitive sensors, magnetic sensors, temperature sensors, vibrations sensors, sway sensors, smart sensors, and weight sensors.

The lifting assembly 100 may comprise at least a portion of a closed loop control system 150. The closed loop system 150 may comprise control elements selected from the group consisting of sensors 112, control units 113, transmission mediums (not shown), power sources 114, actuators (not shown), indicators 1400, 1401 (see FIG. 14), and computer memory 115.

The closed loop system 150 may perform the following method. A sensor 112 may detect the position of a desired object 110 relative to the clamping assemblies 101. The control unit 113 may send a signal through a transmission medium (not shown) to an actuator (not shown) to move the frame structure 109 and position the clamping assemblies 101 over the object 110. When the clamping assemblies 101 are in position the control unit 113 may actuate the power source 114 to open the clamping assemblies 101 and to the actuators to lower the frame structure 109 until the clamping assemblies 101 surround the object 110. The control unit 113 may send another signal to the power source 114 to close the clamping assemblies 101. If a good grip is not made, the control unit 113 may send signals to open the clamping assemblies 101 and make another attempt to grip the object 110. This method may be continued until a good grip is made. If a good grip is made the lifting assembly 100 may move the frame structure 109 with attached clamping assemblies 101 to a specified location for releasing the object 110. The closed loop system 150 may continue this method 110 until an assigned task is finished and/or the sensor 112 does not detect any more objects 110 to be moved.

If an RFID is included on the object, the lifting assembly 100 may query the RFID and remember where the lifting assembly 100 stored the object 110. This may be useful in a storage facility where an operator may request the lifting assembly 100 to transport an object 110 to a certain location. The operator may input a task including the RFID code to designate which object 110 should be moved and a location code to designate where the object 110 should be moved to.

The lifting assembly 100 may then independently carry out the operations to fulfill the task.

Figure 2:
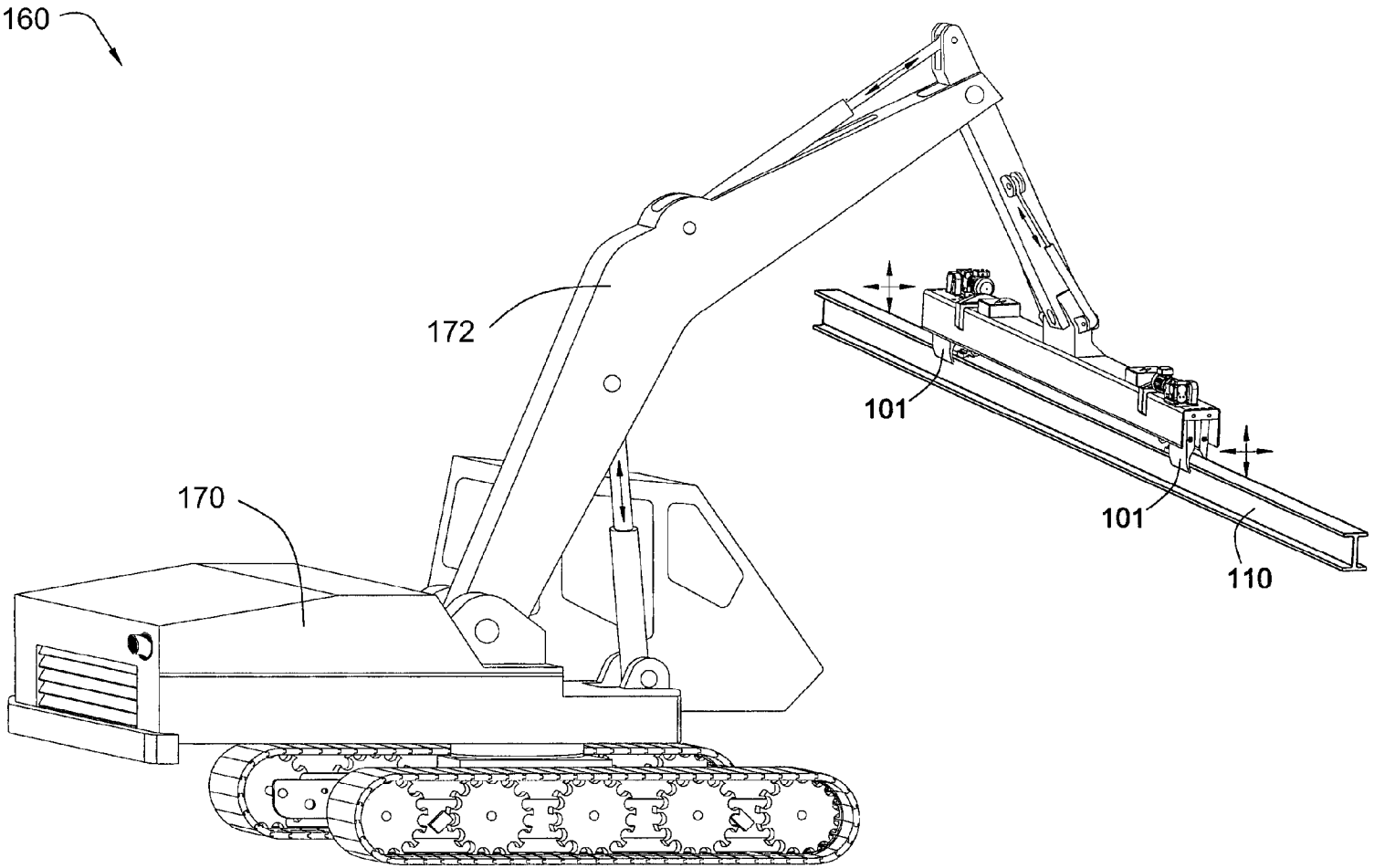
FIG. 2 is a perspective diagram of a mobile lifting assembly with multiple clamping assemblies.

FIG. 2 is a perspective view of another lifting assembly 160 comprising two clamping assemblies 101. The lifting assembly 160 comprises a mobile base 170 and an adjustable arm 172. In this embodiment the lifting assembly 160 may grip objects 110 of varying size, shape, and weight and transport them from one location to another location.

Figure 3:
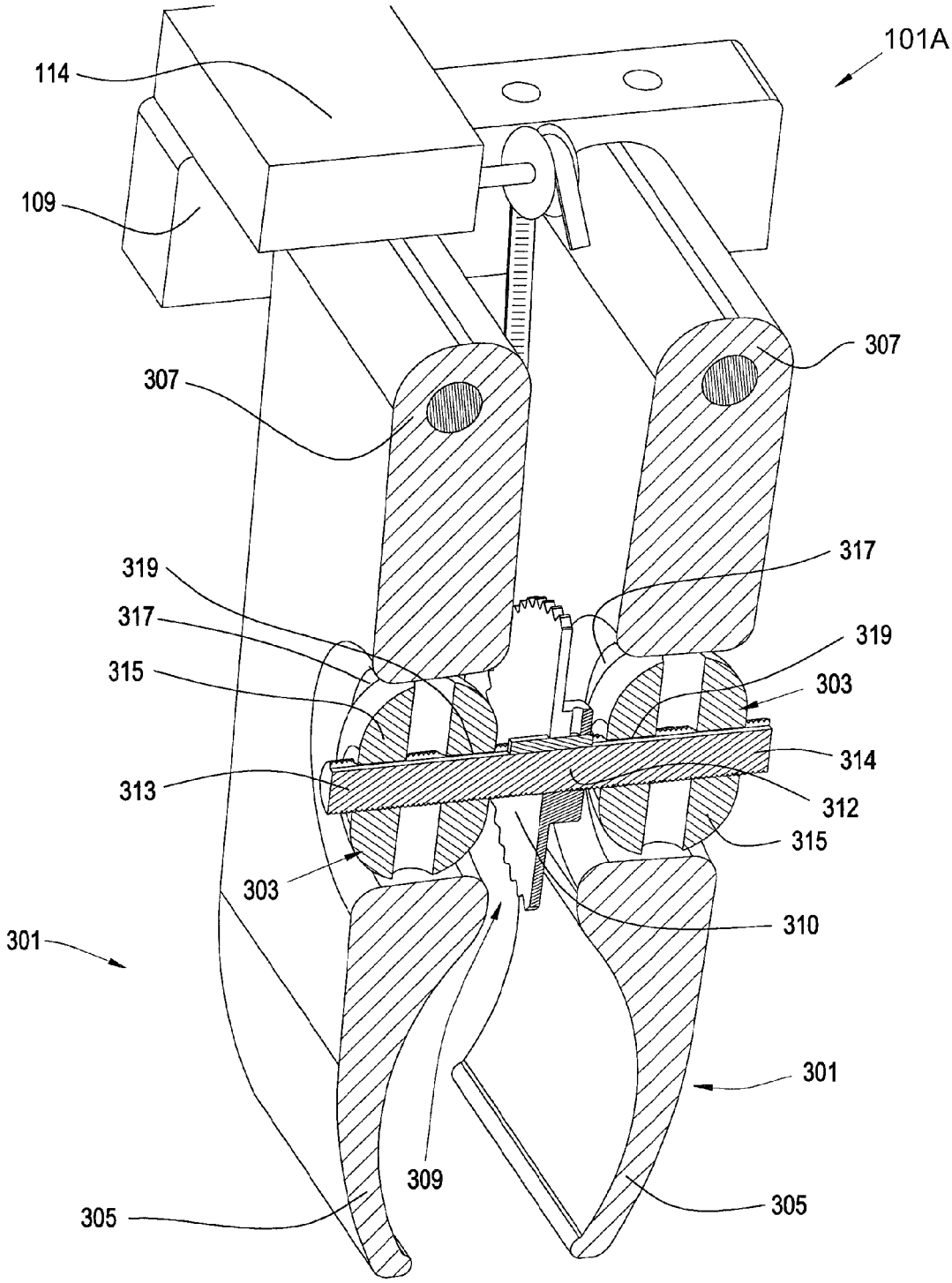
FIG. 3 is a perspective cross-sectional diagram of a clamping assembly.

FIG. 3 is a perspective cross-sectional view of a clamping assembly 101A comprising opposed jaws 301 each comprising a ball and socket apparatus 303 intermediate a clamp end 305 and a pivot end 307 attached to a frame structure 109. The ball and socket apparatuses 303 are connected by a gear assembly 309 comprising a primary gear 310 in mechanical communication with a power source 114. Wherein, the jaws 301 are actuated in accordance with the rotation of the primary gear 310.

The gear assembly 309 may comprise a rod 312 comprising the primary gear 310 intermediate oppositely threaded ends 313, 314 threadedly connected to the ball and socket apparatuses 303. The ball and socket apparatuses 303 may comprise a ball 315 pivotally mounted within a corresponding socket 317. The balls 315 of the ball and socket apparatuses 303 may be any shape which may allow the balls 315 to pivot within their corresponding sockets 317. The sockets 317 may extend through the corresponding jaws 301. Each of the balls 315 may further comprise an internally threaded bore 319 adapted for connection to the oppositely threaded ends 313, 314 of the rod 312. The rotation of the rod 312 may cause each of the balls 315 to move linearly in opposite directions along the rod 312. There may be enough friction between the internally threaded bores 319 and the rod 312 to prevent a force generated from the weight of an object 110 held within the jaws 301 to move the balls 315 along the rod 312 and open the jaws 301. This may be advantageous if there is a power failure. The primary gear 310 may be selected from the group consisting of spur gears, helical gears, crossed helical gears, bevel gears, spiral bevel gears, hypoid gears, and zerol gears.

Figure 4:
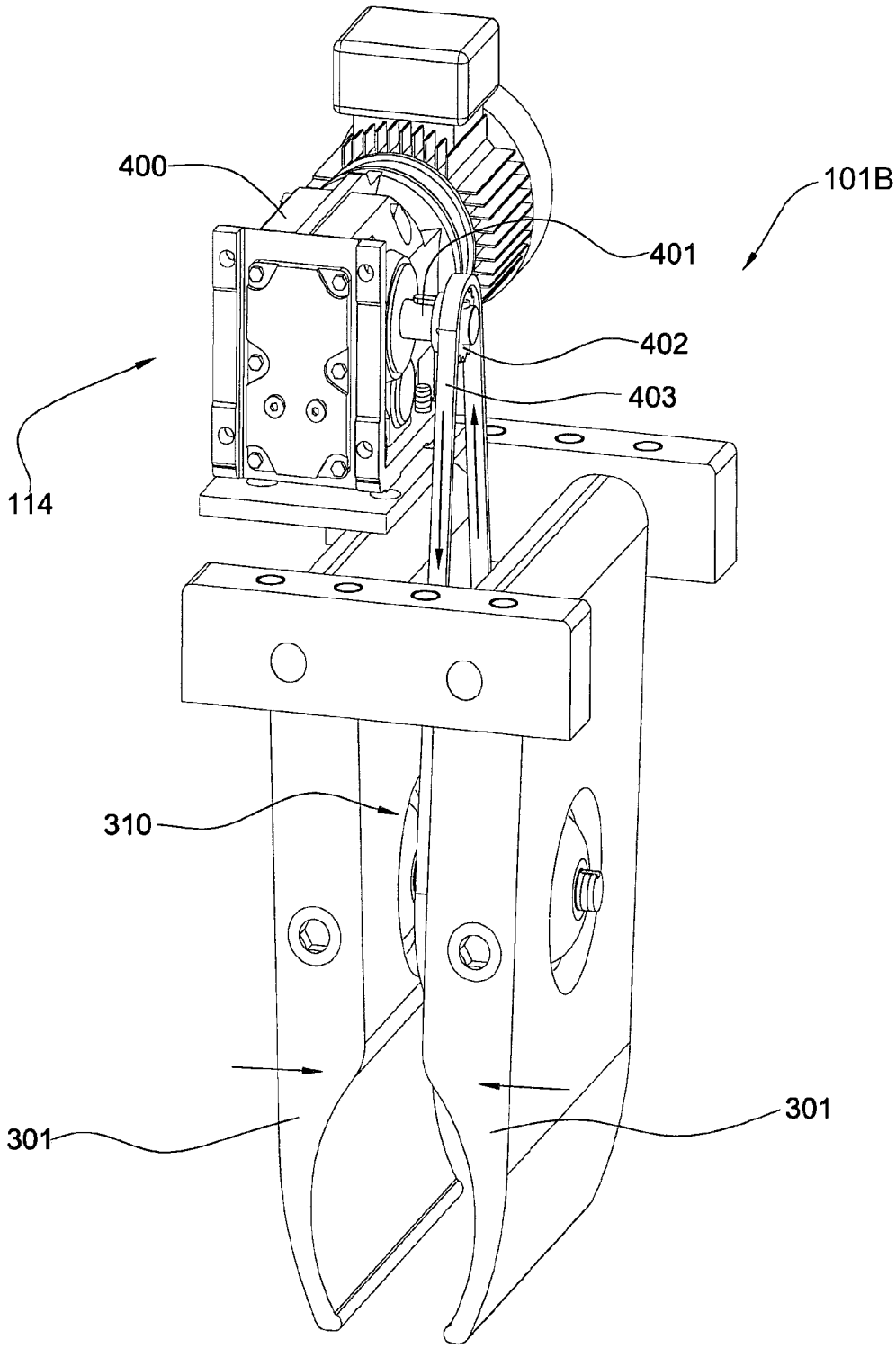
FIG. 4 is a perspective diagram of a clamping assembly.

FIG. 4 is a diagram of the clamping assembly 101B with a motor 400 as the power source 114. A shaft 401 on the motor 400 may comprise a second gear 402 in mechanical communication with the primary gear 310. The second gear 402 may be a corresponding spur gear, helical gear, crossed helical gear, bevel gear, spiral bevel gear, hypoid gear or zerol gear. The second gear 402 may also be a worm gear (not shown). The worm gear (not shown) may provide the advantage of being able to turn the primary gear 310 but the primary gear 310 may not be able to turn the worm gear (not shown). This may add safety to the clamping assembly 101B by preventing the jaws 301 from opening during a power failure.

Figure 5:
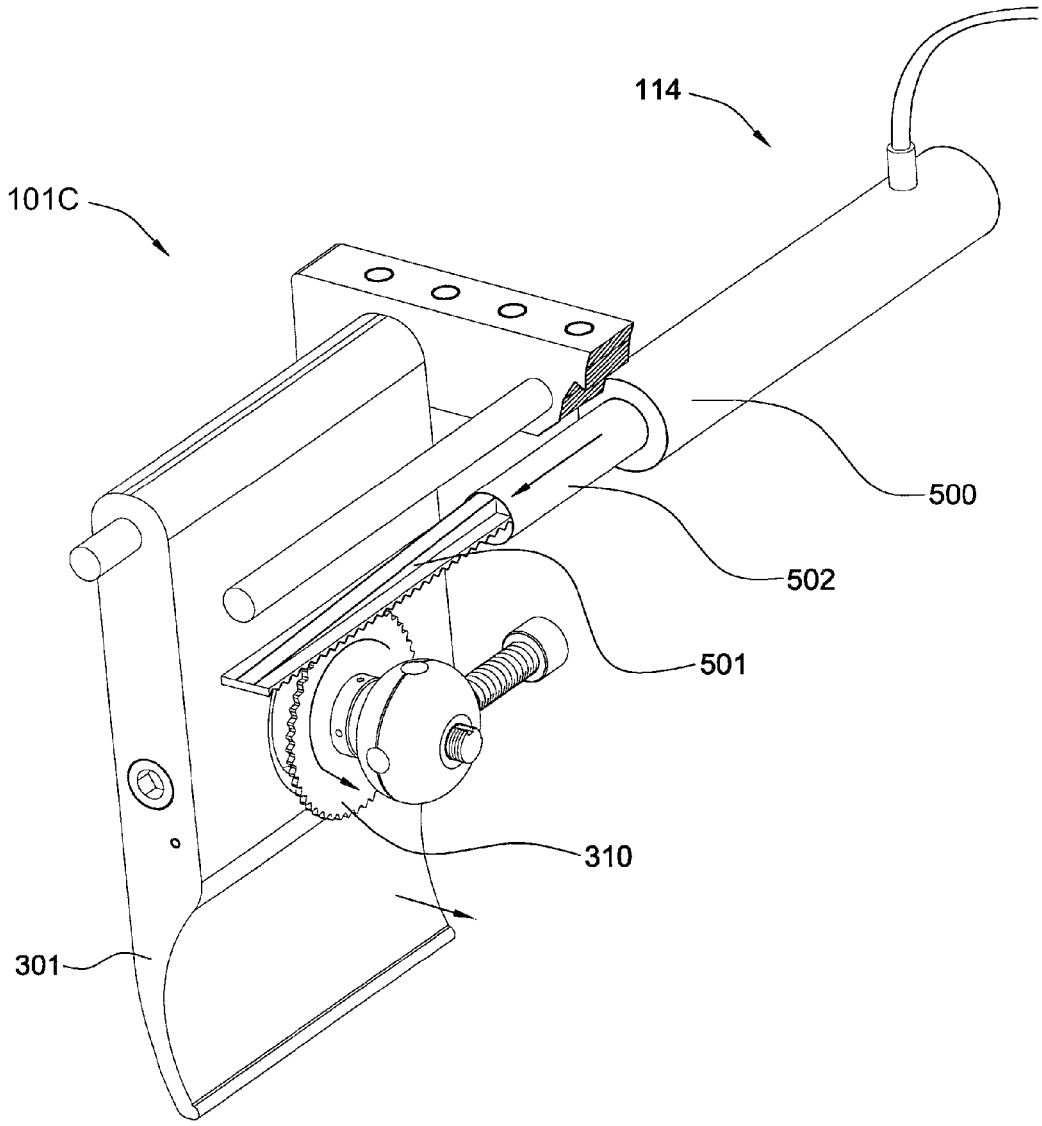
FIG. 5 is a perspective diagram of a portion of a clamping assembly.

The power source 114 may further be selected from the group consisting of motors, engines and hydraulics. The power source 114 may be in mechanical communication with the primary gear 310 by a mechanical device 403 selected from the group consisting of gears, belts, bands, wheels, pulleys, chains, ropes, rods, shafts, and combinations of the above. FIG. 5 is a diagram of a clamping assembly 101C comprising a hydraulic 500 as the power source 114. A rack gear 501 may be attached to the end of the hydraulic piston 502. The rack gear 501 may be positioned on the primary gear 310 such that the actuation of the hydraulic 500 moves the rack gear 501 along the primary gear 310 resulting in the opening or closing of the jaws 301 of the clamping assembly 101C.

Figure 6:
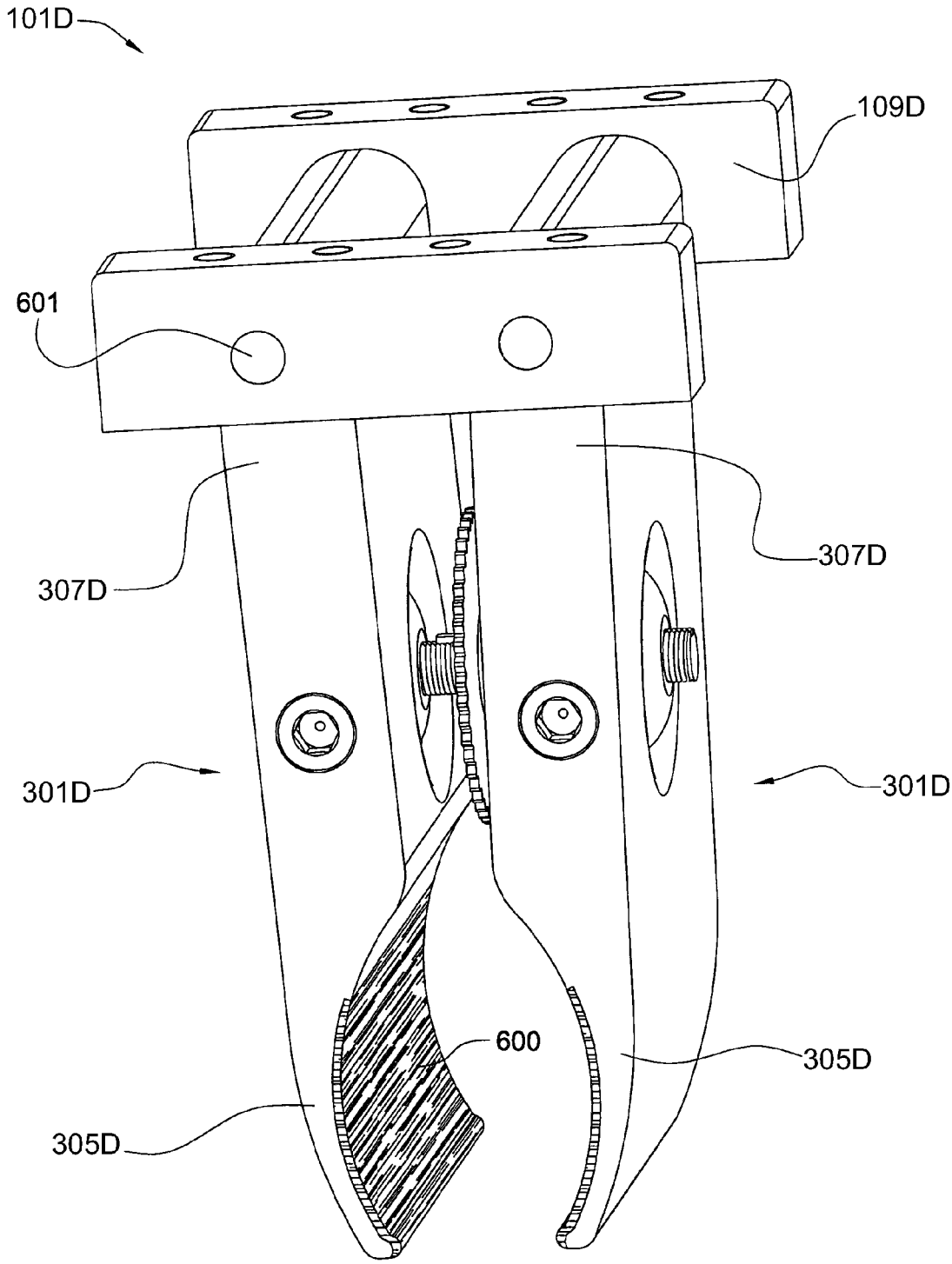
FIG. 6 is a perspective diagram of a clamping assembly.

Referring now to FIG. 6, the clamp end 305D of the clamping assembly 101D may comprise a gripping surface 600 selected from the group consisting of elastomers coated surfaces, grooves, curved surfaces and rough surfaces. The pivot end 307D of the jaws 301D may be attached to the frame structure 109D by a connection 601 selected the group consisting of hinges, swivels, ball and sockets apparatuses, and pivots.

Figure 7:
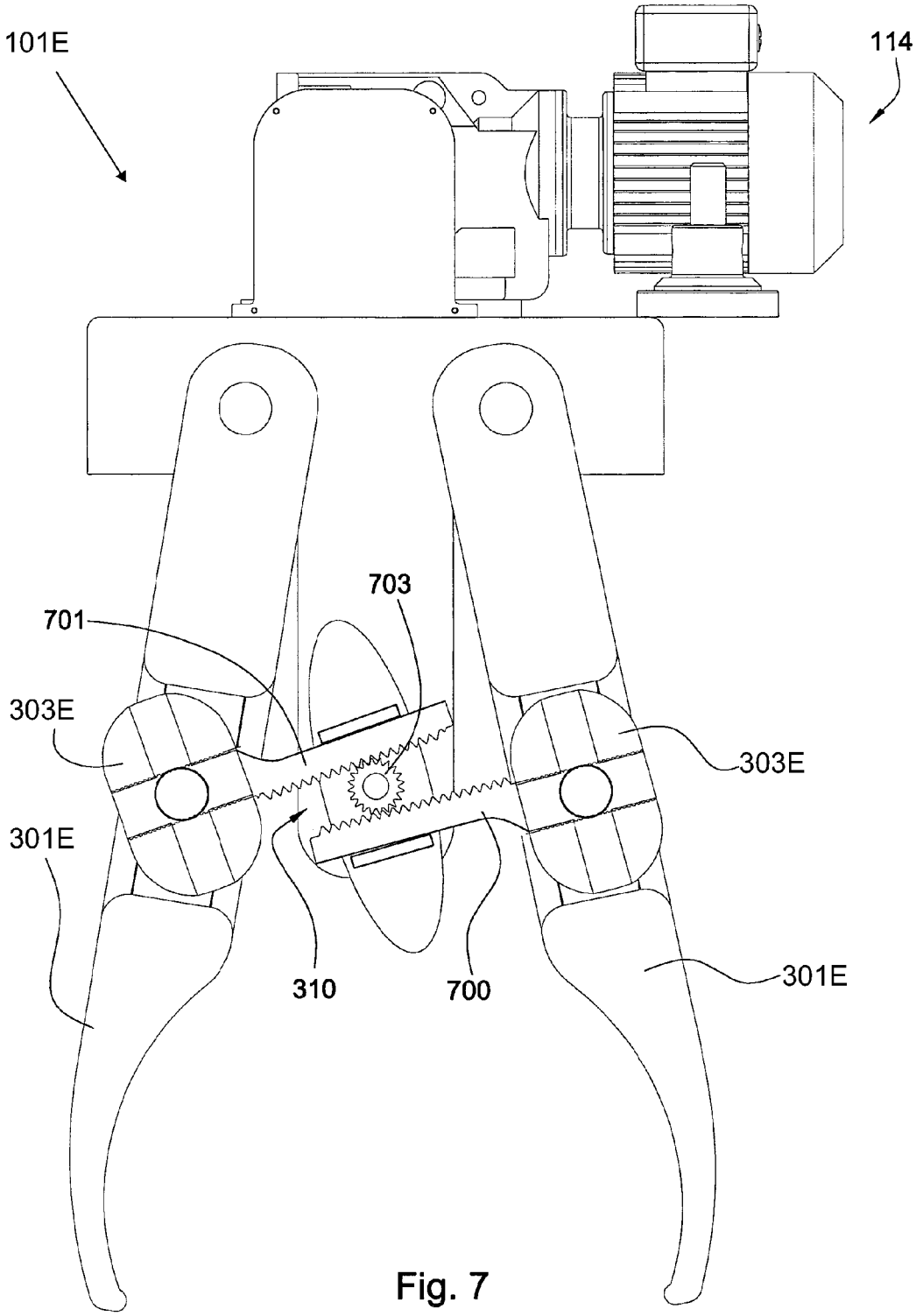
FIG. 7 is a schematic diagram of a clamping assembly.

Referring to the clamping assembly 101E illustrated in FIG. 7, the primary gear 310 may further be a pinion gear 703 in mechanical communication with rack gears 700, 701 pivotally connected to opposing ball and socket apparatuses 303E. As the pinion gear 703 is actuated by the power source 114 the rack gears 700, 701 placed on opposite sides of the pinion gear 703 may move linearly in opposing directions. This movement may cause the jaws 301E to open or close depending on the direction of rotation of the pinion gear 703.

Figure 8:
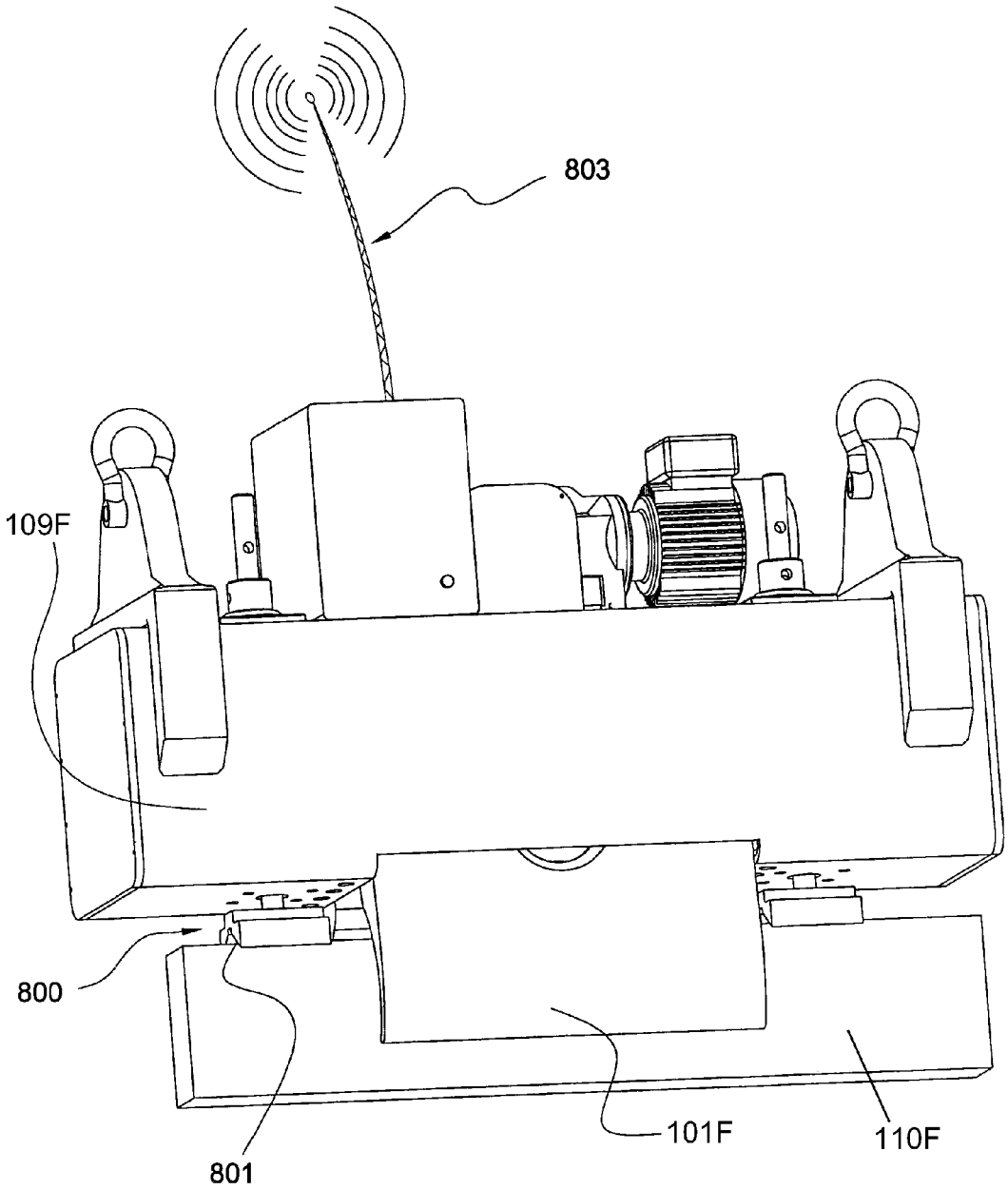
FIG. 8 is a perspective diagram of a clamping assembly.

In some embodiments of the present invention, the frame structure 109F may comprises a single clamping assembly 101F as diagramed in FIG. 8. The clamping assembly 101F may comprise an antenna 803 in communication with a remote operator. This may allow the clamping assembly 101F to be controlled wirelessly from a remote location. The frame structure 109F of the clamping assembly 101F may comprise a stabilizing member 800. The stabilizing member 800 may add one or more points of contact 801 between the clamping assembly 101F and the clamped object 110F. The stabilizing member 800 may further help in centering the object 110F to be clamped. Because of the added points of contact 801, the position of the object 110F may be known to a more precise degree. This may be useful in an application where the clamping assembly 101F transports objects 110F from a holding location (not shown) to a machine 1402, such as the lathe 1403 diagramed in FIG. 14. In some aspect of the invention, the stabilizing member 800 may be adjustable manually or electrically through use of a motor and gearing (not shown).

Figure 9:
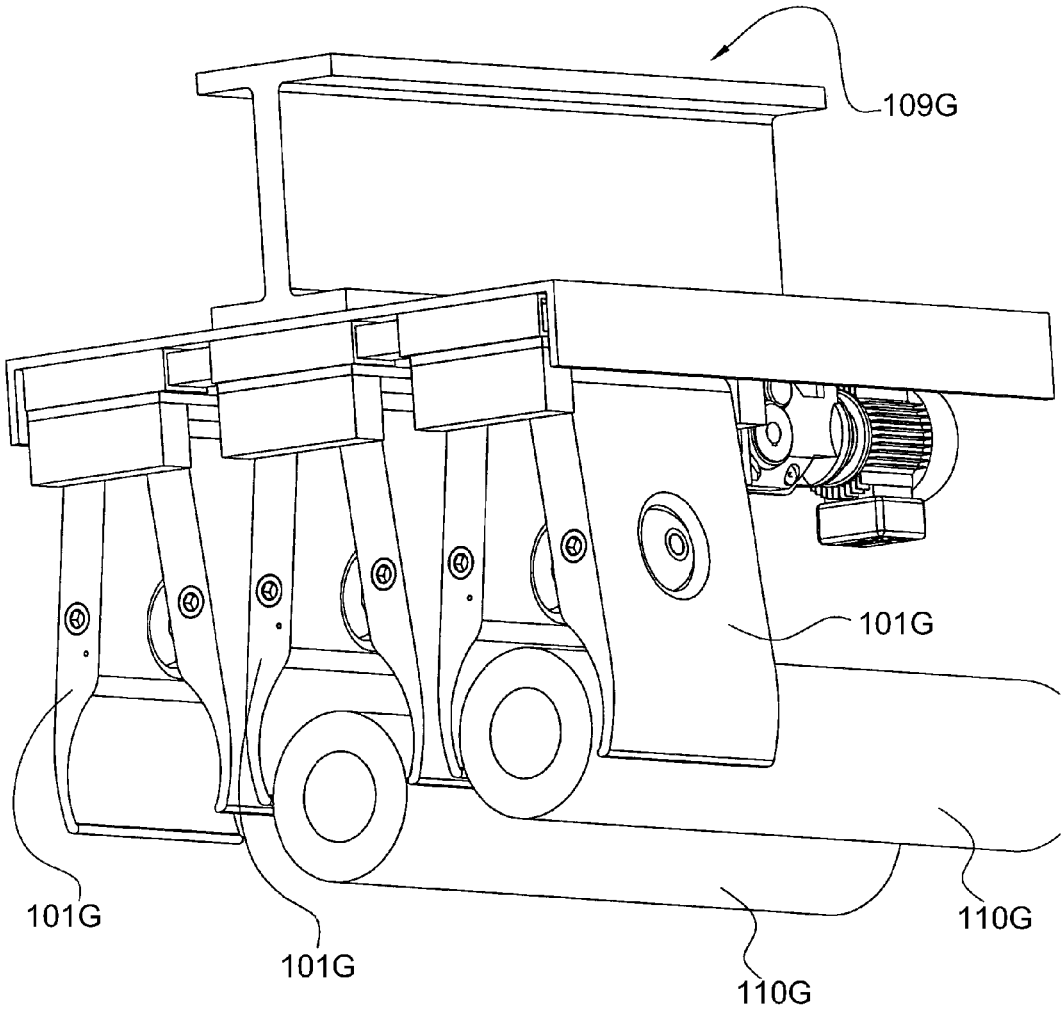
FIG. 9 is a perspective diagram of a frame structure with multiple clamping assemblies.

FIG. 9 is a perspective diagram of a frame structure 109G with multiple clamping assemblies 101G. The multiple clamping assemblies 101G may be mounted parallel to one another along the frame structure 109G. The parallel mounted clamping assemblies 101G may be able to grip objects 110G of varying widths or diameters simultaneously. The clamping assemblies 101G may further be mounted along a common axis 111 as diagramed in FIG. 1. With this orientation the clamping assemblies 101G may be able to grip irregular objects 110G with varying widths or diameters (see FIG. 13).

Figure 10:
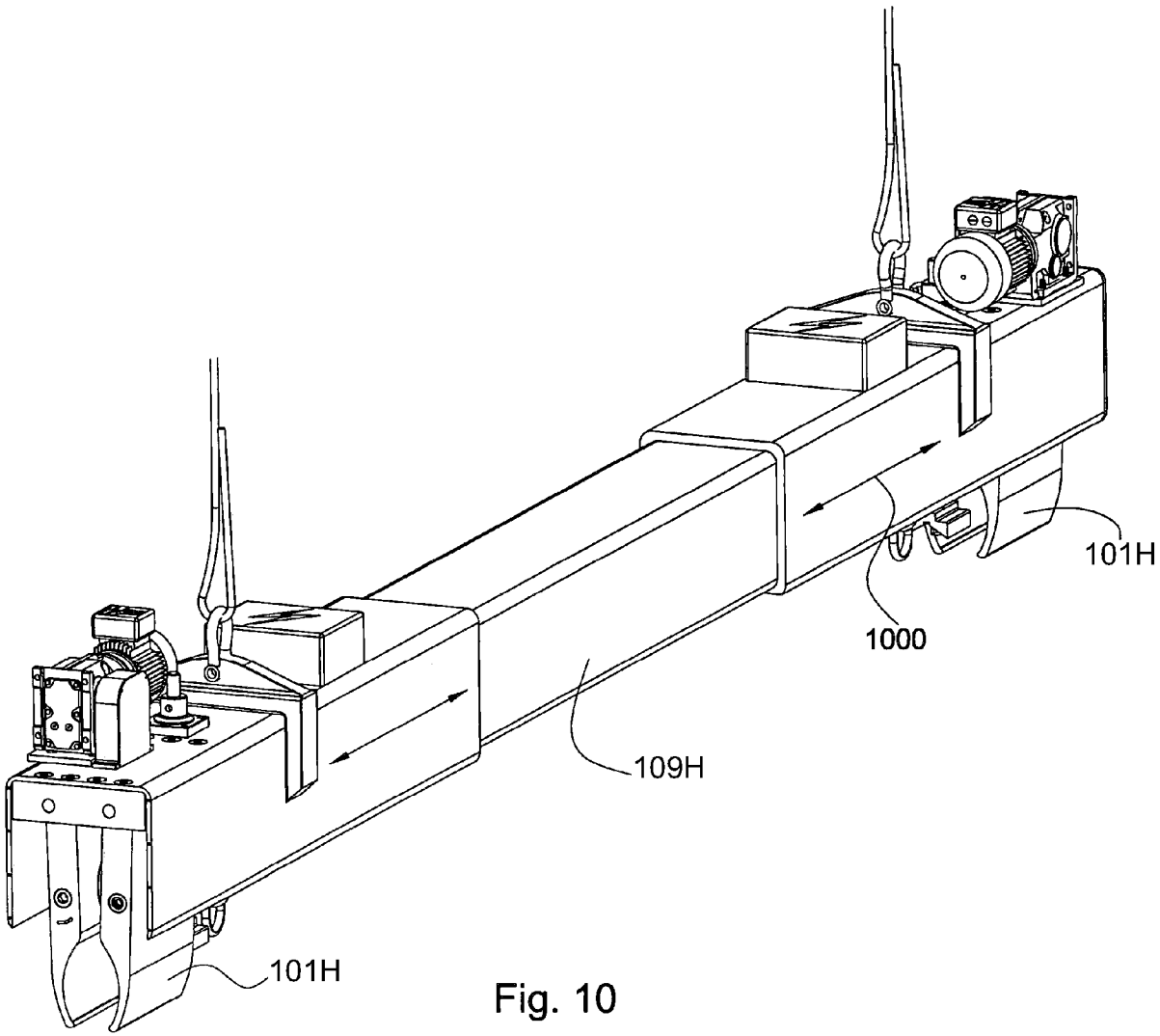
FIG. 10 is a perspective diagram of two clamping assemblies adapted to move horizontally along the frame structure.
Figure 11:
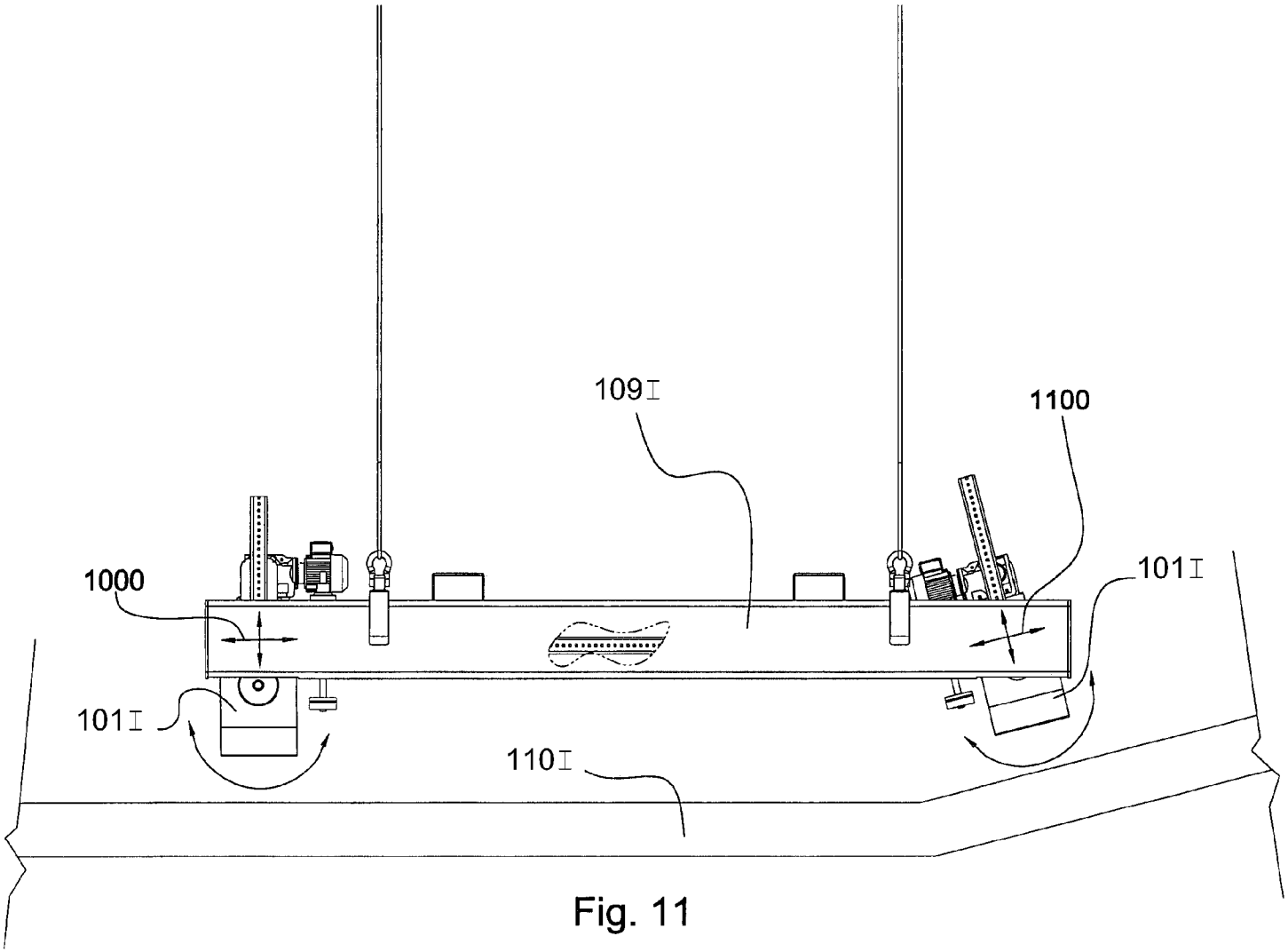
FIG. 11 is an orthogonal diagram of two clamping assemblies adapted to rotate with respect to the frame structure.

Referring now to FIG. 10, the clamping assemblies 101H are adapted to move in a horizontal direction 1000 along the frame structure 109H. Alternatively, the clamping assemblies 101I may be able to move in a vertical direction 1100, a horizontal direction 1000, or both directions 1000, 1100 with respect to the frame structure 109I, as diagramed in FIG. 11. The ability to move in a horizontal direction 1000 and vertical direction 1100 along the frame structure 109I may add versatility to the clamping assemblies 101I by accommodating the gripping of objects 110I of varying sizes, shapes, and lengths. FIG. 11 further diagrams shows that the clamping assemblies 101I may rotate with respect to the frame structure 109I. This may add more versatility to the clamping assemblies 101I by allowing the clamping assemblies 101I to grip an object 110I positioned at an angle with respect to the frame structure 109I or an object 110I comprising a bend.

Figure 12:
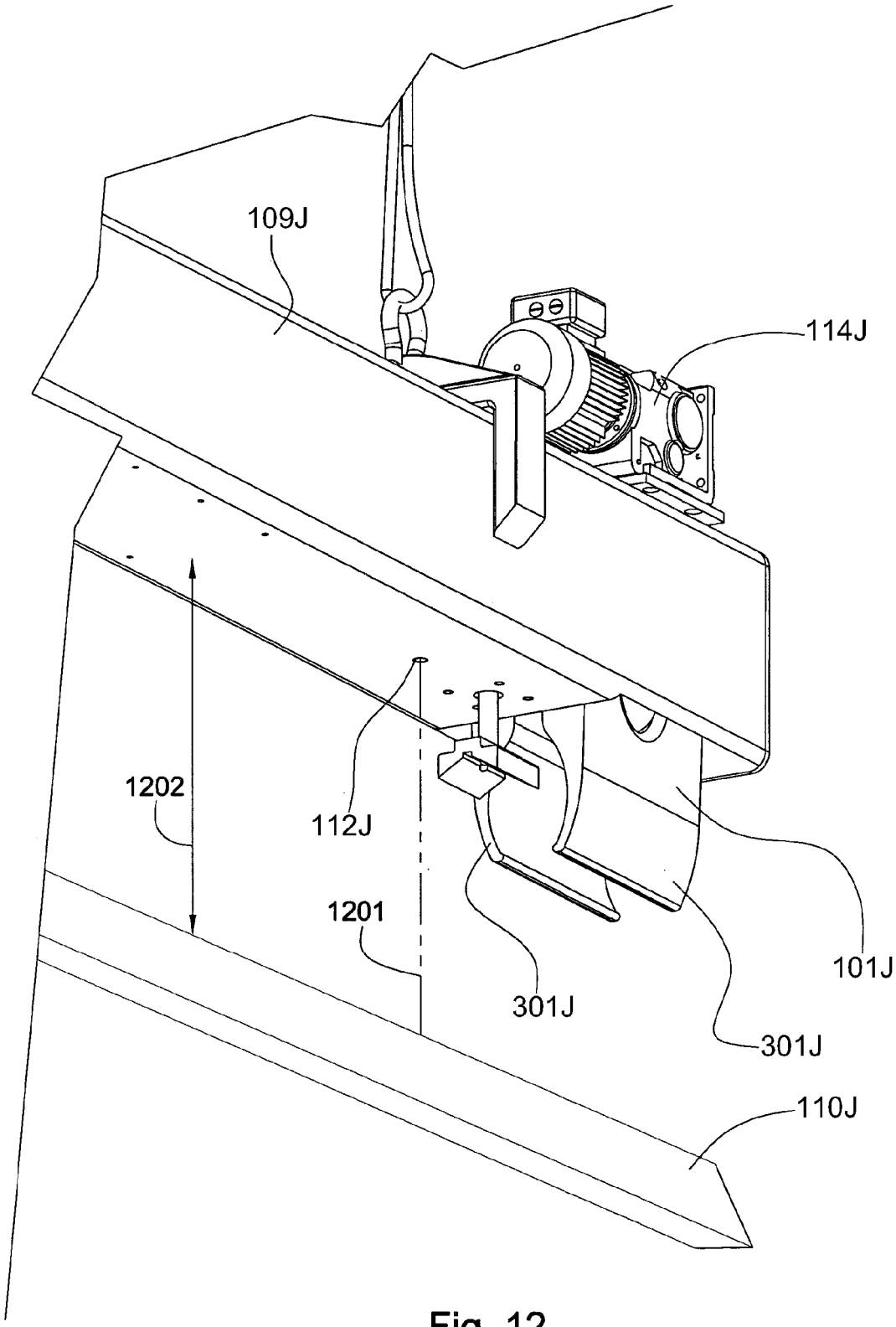
FIG. 12 is a perspective diagram of a clamping assembly comprising a positioning sensor.

Referring to FIG. 12, the clamping assembly 101J may comprise a sensor 112J selected from the group consisting of torque sensors, pressure sensors, position sensors, strain sensors, optical sensors, sonic sensors, seismic sensors, acoustic sensors, inductive sensors, capacitive sensors, magnetic sensors, temperature sensors, vibrations sensors, sway sensors, smart sensors, and weight sensors. The sensor 112J may be attached on the jaws 301J, the power source 114J, or the frame structure 109J. A torque sensor (not shown) may be used to determine if the clamping assembly 101J has a sufficient grip on the clamped object 110J.

A smart sensor may be used to determine if a good grip has been made. A smart sensor (not shown) may be made of a smart material that changes either its mechanical, electrical, or magnetic properties due to some change in its external environment. For example, a smart sensor may measure the amount of stress along the jaws 301J. The measured value of stress may then be analyzed with known values to determine the amount of force the jaws 301J are applying around the clamped object 110J. A smart sensor may also be useful in determining the position of the object 110J when held within the jaws 301J. If the object 110J is not held in a proper position within the jaws 301J, the sensors 112J may measure a larger amount of stress along the jaws 301J than would be expected which may signal that a bad grip has been made.

In other representative embodiments, a pressure sensor may also be used to find the amount of force applied to the clamped object 110J. An optical sensor may be used to determine the distance 1202 of the object 110J relative to the clamping assembly 101J. A laser (not shown) may send out a beam of light 1201 and an optical sensor may receive the reflected light which may then be processed to determine the distance 1202 the object 110J is relative to the clamping assembly 101J. Acoustic, sonic and seismic sensor may be used to determine the relative position of the clamping assembly 101J with respect to the object 110J by sending a signal out and processing the reflections. Inductive and capacitive sensors may be used to determine if the object 110J is positioned within the jaws 301J far enough to get a good grip by measuring the change in capacitance or inductance that may result when the object 110J to be clamped is within the jaws 301J. A sensor 112J may be used in accordance with the jaws 301J to determine the width of the object 110J. It is believed that a variety of sensors 112J may be used in a variety of ways and the above reference to certain uses for certain sensors is not meant to limit their scope relating to the present invention.

Figure 13:
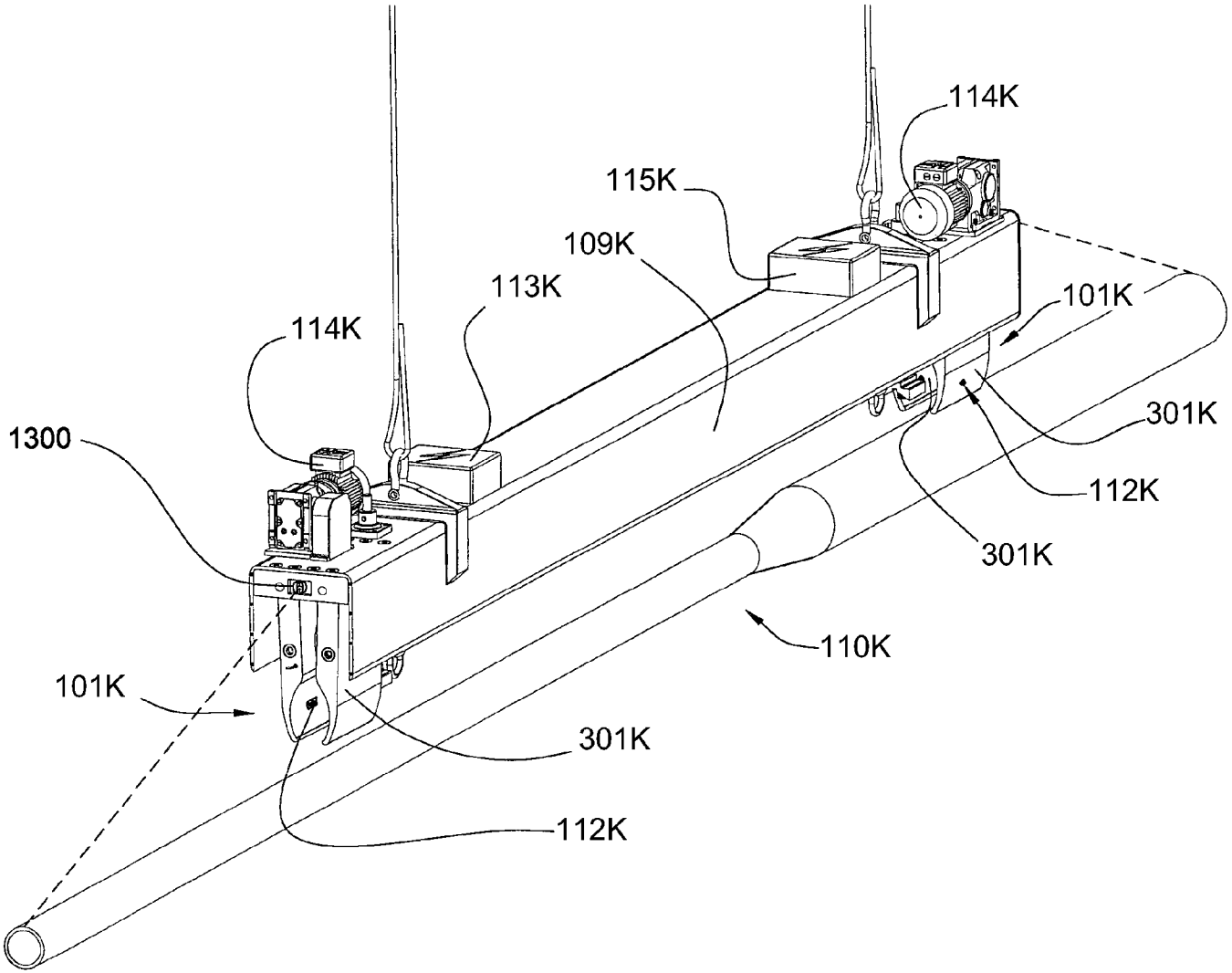
FIG. 13 is a perspective diagram of a clamping assembly with multiple sensors.

Referring to FIG. 13, the clamping assembly 101K may comprise a control unit 113K selected from the group consisting of integrated circuits, microprocessor chips and field programmable gate arrays (FPGA's). The clamping assembly 101K may comprise a portion of a closed loop control system. The closed loop control system may include control elements selected from the group consisting of sensors 112K, control units 113K, transmission mediums (not shown), power sources 114K, actuators (not shown), indicators 1400, 1401 (see FIG. 14), and computer memory 115K.

A sensor 112K in electrical communication with the control unit 113K may determine the position of the clamping assembly 101K with respect to the object 110K to be clamped. The sensors 112K may also determine the length of the object 110K with a laser 1300 or camera (not shown) mounted on each side of the frame structure 109K scanning until the object 110K is reached. The control unit 113K may then be able to take the data received from the sensors 112K and determine the objects 110K length. Once the length of the object 110K is known, the clamping assemblies 101K may be moved along the frame structure 109K into a position that may provide the preferred grip. The control unit 113K may then communicate with the clamping assembly 101K to actuate the power source 114K in order to open and close the jaws 301K. When the jaws 301K are closed the control unit 113K may determine through the sensors 112K whether a good or bad grip has been made. If a good grip is indicated, the control unit 113K may then transmit a signal to actuate the power source 114K and open the jaws 301K. After the jaws 301K are open the control unit 113K may then send a second signal to actuate the power source 114K and attempt to grip the object 110K a second time. This process may continue until a good grip has been made. The sensors 112K may send a signal to the control unit 113K when the clamping assembly 101K is at the drop off location. The control unit 113K may then send a signal to the power source 114K to open the jaws 301K and release the object 110K.

The control unit 113K may receive operating instructions from an input device (not shown) selected from the group consisting of controllers, remote controls, radio controls, sensors, memory, and computers. The operating instructions may be converted into signals to turn on and off the power source 114K of the clamping assembly 101K. The operating instructions may be converted into signals to adjust the position and angle of the clamping assembly 101K with respect to the frame structure 109K. For example, in embodiments where the frame structure 109K comprises two clamping assemblies 101K, if one clamping assembly 101K is failing, a signal may be sent to the other clamping assembly 101K to increase its grip. Further, if a sensor 112K on the clamping assembly 110K measures a sudden increase in weight or torque, the control unit 113K may respond by increasing the grip on the object 110K held within the jaws 301K.

Figure 14:
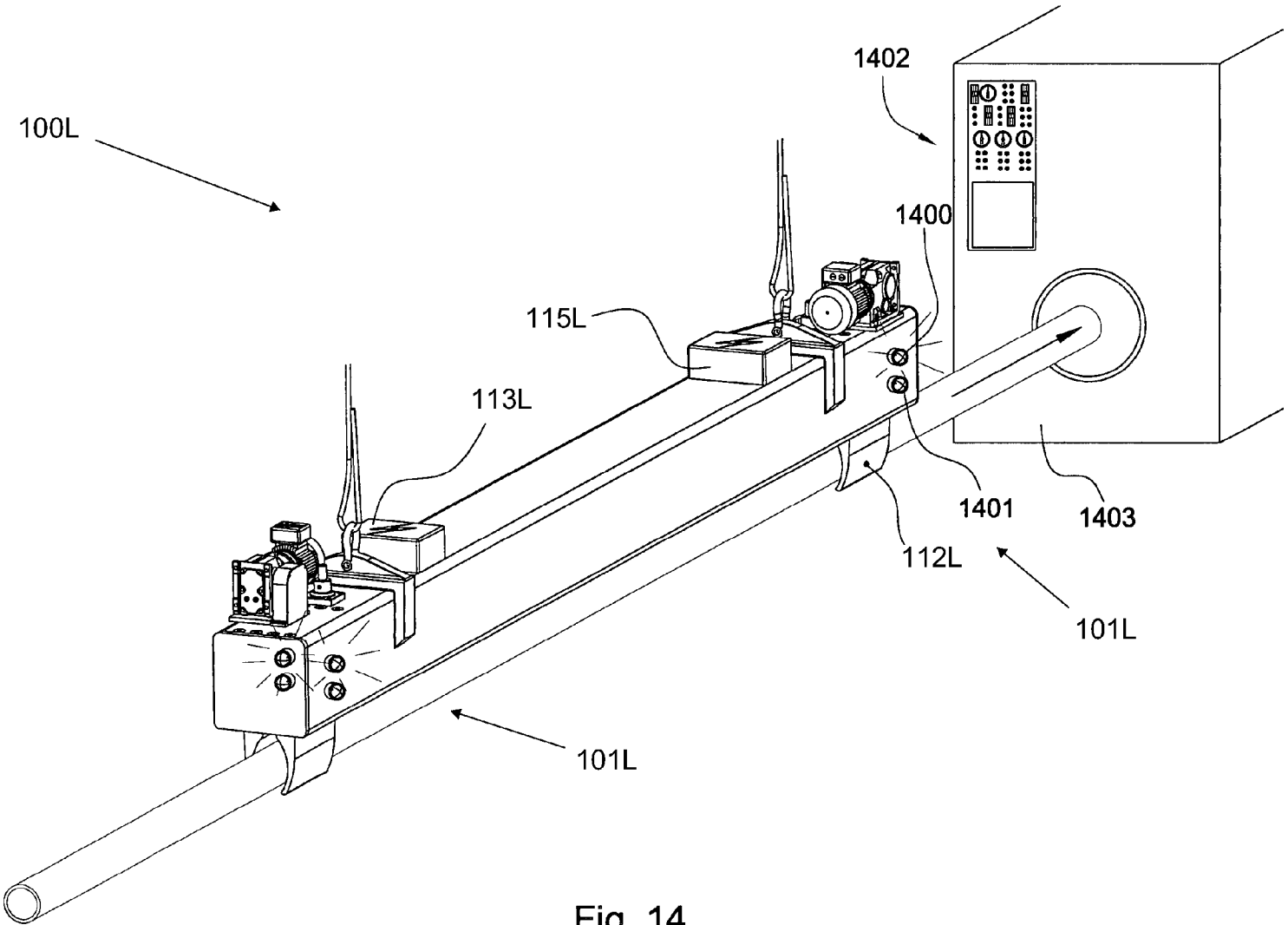
FIG. 14 is a perspective diagram of a clamping assembly with an indicator.

As diagramed in FIG. 14, the clamping assemblies 101L may comprise computer memory 115L for use with computerized control unit 113L. The computer memory 115L may store operating instructions for routine tasks. The computer memory 115L may also store values for the control unit 113L to compare with real time values obtained by sensors 112L to determine when the clamping assemblies 101L have a good or bad grip, or when the clamping assemblies 101L are in the correct position. When a bad grip is made or the clamping assemblies are out of position, it may be read as an error and a signal may be sent from the control unit 113L to an indicator 1400. The indicator 1400 may be a light source or an acoustic source. Indicators 1400, 1401 may be used to indicate a good or bad grip or warn an operator or others nearby of danger such as a power failure or a slipping object. In other aspects of the invention, the indicators 1400, 1401 may be video monitoring devices (not shown). The video monitoring devices (not shown) may send real time images over a network regarding the position and the surroundings of the clamping assemblies 101L. This may allow an operator, such as an IntelliLift™ operator, to control numerous lifting assemblies 100L over the network from a single location. This may be advantageous because of the reduction of man hours required to operate the lifting assembly 100L. Further, having a remote operator may reduce the need for men to handle hazardous materials such as corrosive or hot material.

Whereas the present invention has been described in particular relation to the drawings attached hereto, it should be understood that other and further modifications apart from those shown or suggested herein, may be made within the scope and spirit of the present invention.

What is claimed is:

1. A clamping assembly for gripping an object, the clamping assembly comprising:

a pair of opposed jaws, each jaw including:

a pivot end pivotally attached to a frame structure;

a clamp end opposite the pivot end; and a socket located between the clamp end and the pivot end;

first and second balls, each ball rotatably mounted in one of the sockets of the opposed jaws; and a gear assembly connected to each of the first and second balls, the gear assembly including a primary gear mechanically associated with a power source, the primary gear being movable by the power source in a first direction to separate the clamp ends of the opposed jaws and in a second direction to bring together the clamp ends to grip an object there between.

2. The clamping assembly of claim 1, wherein each of the first and second balls include a threaded bore formed therein and the gear assembly further comprises a rod disposed between the opposed jaws and having first and second threaded ends engaged with the threaded bores of the first and second balls, respectively.

3. The clamping assembly of claim 1, wherein the primary gear is selected from the group consisting of spur gears, helical gears, crossed helical gears, bevel gears, spiral bevel gears, hypoid gears and zero gears.

4. The clamping assembly of claim 1, wherein the primary gear is a pinion gear in mechanical communication with rack gears pivotally connected to the ball and socket apparatuses.

5. The clamping assembly of claim 1, wherein the frame structure comprises a stabilizing member.

6. The clamping assembly of claim 1, wherein the clamping assembly comprises a sensor selected from the group consisting of torque sensors, pressure sensors, position sensors, strain sensors, optical sensors, sonic sensors, seismic sensors, acoustic sensors, inductive sensors, capacitive sensors, magnetic sensors, temperature sensors, vibrations sensors, sway sensors, smart sensors, and weight sensors.

7. The clamping assembly of claim 1, wherein the clamping assembly moves in a horizontal direction, a vertical direction or both directions with respect to the frame structure.

8. The clamping assembly of claim 1, wherein the clamping assembly rotates with respect to the frame structure.

9. The clamping assembly of claim 1, wherein the clamping assembly comprises a control unit controlling the power source, the control unit selected from the group consisting of integrated circuits, microprocessor chips and field-programmable gate arrays.

10. The clamping assembly of claim 9, wherein the control unit receives operating instructions from an input device selected from the group consisting of controllers, remote controls, radio controls, sensors, computer memory, and computers.

11. The clamping assembly of claim 9, wherein the control unit forms a portion of a closed loop control system controlling the clamping assembly, the closed loop control system including additional control system elements selected from the group consisting of sensors, transmission mediums, power sources, actuators, indicators, and computer memory.

12. The clamping assembly of claim 1, wherein the power source is selected from the group consisting of motors, engines and hydraulics.

13. The clamping assembly of claim 1, wherein the power source is in mechanical communication with the primary gear by a mechanical device selected from the group consisting of gears, belts, bands, wheels, pulleys, chains, ropes, rods, shafts and combinations of the above.

14. The clamping assembly of claim 1, wherein the clamp end comprises a gripping surface selected from the group consisting of elastomer coated surfaces, grooves, curved surfaces, and rough surfaces.

15. The clamping assembly of claim 1, wherein the pivot end of the jaw is pivotally attached to the frame structure by a connection selected the group consisting of hinges, swivels, ball and sockets apparatuses and pivots.

16. A lifting assembly for gripping and moving an object, the lifting assembly comprising:

a movable frame structure; and at least one clamping assembly supported on the frame structure, the clamping assembly including:

a pair of opposed jaws, each jaw having a pivot end pivotally attached to the frame structure, a clamp end opposite the pivot end, and a socket located between the pivot end and the clamp end having a ball rotatably disposed therein; and a gear assembly connected to each ball of the opposed jaws, the gear assembly including a primary gear mechanically associated with a power source, the primary gear being movable by the power source in a first direction to operate the gear assembly and separate the opposed jaws and in a second direction to operate the gear assembly and bring together the opposed jaws to grip the object there between.

17. The lifting assembly of claim 16, wherein the lifting assembly comprises a sensor selected from the group consisting of torque sensors, pressure sensors, position sensors, strain sensors, optical sensors, sonic sensors, seismic sensors, acoustic sensors, inductive sensors, capacitive sensors, magnetic sensors, temperature sensors, vibrations sensors, sway sensors, smart sensors, and weight sensors.

18. The lifting assembly of claim 16, further comprising a closed loop control system controlling the lifting assembly, the closed loop control system including a plurality of control system elements selected from the group consisting of sensors, control units, transmission mediums, power sources, actuators, indicators, and computer memory.

19. A clamping assembly for gripping an object, comprising:

a frame structure;

a pair of opposed jaws, each jaw including:

a pivot end pivotally attached to said frame structure about a pivot axis;

a clamp end opposite said pivot end; and a receptacle configured to receive and retain a ball therein;

first and second balls, each ball rotatably mounted in one of said receptacles about a rotational axis, and with each ball having a bore formed therein; and a gear assembly connected to said bores of said first and second balls, said gear assembly including a primary gear mechanically associated with a power source, said primary gear being movable by said power source to operate said gear assembly in a first direction and separate said clamp ends, and said primary gear being movable by said power source to operate said gear assembly in an opposite direction to bring together said clamp ends to grip said object there between.

20. The clamping assembly of claim 19, wherein said rotational axes of said first and second balls are substantially parallel with said pivot axes of said pivot ends.

21. The clamping assembly of claim 19, wherein said bores are substantially perpendicular to and intersect with said rotational axes of said first and second balls.

22. The clamping assembly of claim 19, wherein said bores are threaded.

23. The clamping assembly of claim 22, wherein said gear assembly further comprises a rod disposed between said opposed jaws and having first and second threaded ends engaged within said threaded bores of said first and second balls, respectively.

24. The clamping assembly of claim 19, further comprising a control unit controlling said power source selected from the group consisting of integrated circuits, microprocessor chips and field-programmable gate arrays.

25. The clamping assembly of claim 24, wherein said control unit forms a portion of a closed loop control system controlling said clamping assembly, said closed loop control system including additional control system elements selected from the group consisting of sensors, transmission mediums, actuators, indicators, and computer memory.

* * * * *